US010697163B2

(12) United States Patent
Schmid et al.

(10) Patent No.: US 10,697,163 B2
(45) Date of Patent: Jun. 30, 2020

(54) ACTUATING DEVICE

(71) Applicant: GEBERIT INTERNATIONAL AG, Jona (CH)

(72) Inventors: Peter Schmid, Zurich (CH); Rene Elsener, Uster (CH); Pascal Brandli, Uster (CH); Stephan Muller, Effretikon (CH); Samuel Schüller, Ettenhausen (CH); Tobias Pluss, Horw (CH)

(73) Assignee: GEBERIT INTERNATIONAL AG, Jona (CH)

( * ) Notice: Subject to any disclaimer, the term of this patent is extended or adjusted under 35 U.S.C. 154(b) by 0 days.

(21) Appl. No.: 16/190,867

(22) Filed: Nov. 14, 2018

(65) Prior Publication Data

US 2019/0145087 A1 May 16, 2019

(30) Foreign Application Priority Data

Nov. 15, 2017 (EP) ..... 17201866

(51) Int. Cl.
*E03D 5/10* (2006.01)
*E03D 5/02* (2006.01)
*E03C 1/05* (2006.01)

(52) U.S. Cl.
CPC ..... *E03D 5/105* (2013.01); *E03C 1/057* (2013.01); *E03D 5/028* (2013.01)

(58) Field of Classification Search
CPC ..... E03D 5/10; E03D 5/105; E03D 5/028; E03C 1/057; E03C 1/055
USPC ..... 4/623
See application file for complete search history.

(56) References Cited

U.S. PATENT DOCUMENTS 5,901,384 A * 5/1999 Sim ..... E03D 5/105 4/302
6,125,482 A 10/2000 Foster
2006/0010591 A1* 1/2006 Bush ..... E03D 5/105 4/406
2006/0169938 A1* 8/2006 Woo ..... E03D 13/005 251/129.04

(Continued)

FOREIGN PATENT DOCUMENTS

DE 11 2014 005 699 T5 9/2016
EP 1 602 788 A1 12/2005

(Continued)

OTHER PUBLICATIONS

European Search Report issued in EP 17 20 1866 dated Apr. 25, 2018.

*Primary Examiner* — Huyen D Le
(74) *Attorney, Agent, or Firm* — Sughrue Mion, PLLC

(57) ABSTRACT

An actuating device for a sanitary fitting comprising a housing (2) having a front side (13) and a rear side (14) and also a detection sensor (3) having a transmitter (4) and a receiver (5) for detecting a user, wherein the detection sensor (3) emits waves via the transmitter (4) and receives them via the receiver (5). The detection sensor (3) is arranged in a cavity (6) that has a radiating region (7*a*), which is transparent to said waves, in the direction of said waves; and wherein the housing (2) is designed such that it is installable having a gap (7*b*) in relation to a predefined installation plane (ME) on the structure side, which gap (7*b*) is located in relation to said radiating region (7*a*) such that the emitted waves and also the waves to be received are guided through the gap (7*b*).

16 Claims, 5 Drawing Sheets

(56) References Cited

U.S. PATENT DOCUMENTS

| | | | | |
|---|---|---|---|---|
| 2012/0228532 | A1* | 9/2012 | Oberholzer | E03D 1/012<br>251/129.01 |
| 2012/0317709 | A1* | 12/2012 | Oates | E03D 5/105<br>4/313 |
| 2016/0312450 | A1 | 10/2016 | Sugino | |
| 2019/0085544 | A1* | 3/2019 | Kutsuzawa | E03D 5/01 |

FOREIGN PATENT DOCUMENTS

| | | | |
|---|---|---|---|
| EP | 2 166 164 | A1 | 3/2010 |
| EP | 2 497 868 | A1 | 9/2012 |
| EP | 3 031 989 | A1 | 6/2016 |
| WO | 99/04283 | A1 | 1/1999 |
| WO | 2016/040986 | A1 | 3/2016 |

* cited by examiner

ACTUATING DEVICE

TECHNICAL AREA

The present invention relates to an actuating device having user recognition according to the preamble of claim 1.

PRIOR ART

Actuating plates for user recognition have become known from the prior art. For example, EP 3 031 989 discloses such an actuating plate, wherein sensors are arranged in a housing.

EP 2 497 868 discloses a further device for electrical activation of a water discharge, wherein the sensors monitor the space in front of the device via specific surface regions in the front side.

The practical use of such actuating plates has moreover shown that the functional reliability can be substantially dependent on the installation situation. Moreover, incorrect actuations often occur, because persons are detected who merely walk past the device and are not interested in an activation.

DESCRIPTION OF THE INVENTION

Proceeding from this prior art, the invention is based on the object of specifying an actuating device having user recognition for the purpose of activating a function, which overcomes the disadvantages of the prior art. A particularly preferred object is to specify an actuating device which permits more reliable user recognition.

The subject matter of claim 1 achieves this object. Accordingly, an actuating device for a sanitary fitting is used for the purpose of activating a function. The function can be, for example, the activation of flushing or the switching on of a light or the starting or actuation of a lower spray nozzle or the opening of a water valve in an outlet fitting or any arbitrary other function. Said actuating device comprises a housing having a front side and a rear side and also a detection sensor having a transmitter and a receiver for detecting a user. The detection sensor emits electromagnetic waves via the transmitter and receives electromagnetic waves reflected from the user via the receiver. The detection sensor is arranged in a cavity of the housing, wherein the cavity has a radiating region in the direction of said electromagnetic waves, which is transparent or transmissive, respectively, to said electromagnetic waves. This means the electromagnetic waves exit from the cavity and enter it again, both via the radiating region. The housing has a lateral face, which extends in the direction of the surface normal on the front side at least partially between front side and rear side, wherein the radiating region is arranged in the region of the lateral face or in the lateral face, respectively.

In other words, the radiating region is substantially located such that the electromagnetic waves exit via the lateral faces of the housing.

This has the advantage that the region to be detected is not a region in front of the front side, but rather another region, namely a region lateral to, in particular below the actuating device, whereby incorrect actuations can be avoided.

The electromagnetic waves preferably pass through the radiating region in the direction of a main direction. The expression "main direction" is understood in the present case as a direction in which the electromagnetic waves move forward shortly after the emission from the transmitter antenna and in which the electromagnetic waves pass the radiating region. After passing the radiating region, the electromagnetic waves propagate based on the local conditions and the antenna characteristic. As explained below, the electromagnetic waves can move forward in a circularly polarizing manner, wherein the main axis is then substantially understood as the axis about which the electromagnetic waves rotate.

With respect to a surface normal oriented perpendicularly to the front face, the main direction of the electromagnetic waves extends substantially perpendicular to the surface normal.

The expression "actuating device" is understood in particular as an actuating plate for the activation of flushing at a toilet or a urinal, or a plate of an outlet fitting or a housing for a shower-toilet or another sanitary device.

Viewed in the installation position, the lateral face having the radiating region is typically substantially oriented in the vertical or the horizontal. The electromagnetic waves preferably move away substantially downward or upward with respect to the housing.

The radiating region can be formed as a passage in the housing or it can be made of a material designed as transparent or transmissive, respectively, to the electromagnetic waves. It is also conceivable that the radiating region is partially formed as a passage in the cavity or in the housing, respectively, and partially is made of a material designed as transparent to the electromagnetic waves.

The expression "transparent" or "transmissive" in conjunction with the radiating region is understood to mean that the emitted and the received electromagnetic waves of the detection sensor can pass through the radiating region. The radiating region does not obstruct the propagation of these electromagnetic waves.

The housing is preferably designed such that it is installable with a gap in relation to an installation plane predefined by the structure, which gap is located in relation to said radiating region such that the electromagnetic waves are guided through the gap. The electromagnetic waves which are emitted and to be received are guided both through the radiating region and also through the gap. The arrangement has the advantage that the user can be detected independently of the installation situation as a result of the arrangement of the radiating region and the gap, because the electromagnetic waves are not obstructed by elements which are in contact with the installation plane or protrude away therefrom, respectively, or by the actuating device itself, but rather can be emitted and received reliably. This means no elements of the installation plane can obstruct the electromagnetic waves in the installed state. In particular, the materialization of the installation plane and the element installed behind the installation plane can be arbitrary.

The expression "gap" is understood as an opening or a passage or an intermediate space. The gap is typically open, i.e., formed without material filling. However, it can also be provided with a material filling transparent to the electromagnetic waves.

The detection sensor is preferably a high-frequency sensor, the frequency of which is in the range of 24 GHz to 24.25 GHz or is 61 GHz or 76 GHz. Other sensors, such as optical or capacitive sensors, can also be used.

One particularly preferred embodiment is characterized in that the transmitter has a transmitter antenna in the form of a patch antenna and/or in that the receiver has a receiver antenna in the form of a patch antenna.

A "patch antenna" is understood as an antenna which extends substantially in one plane. The extension of the patch antenna transversely to the main direction of the electromagnetic waves is preferably substantially formed as a rectangle, in particular as a narrow rectangle.

The expression "main direction" is understood in conjunction with the patch antenna as a direction in which the electromagnetic waves move forward shortly after the emission from the transmitter antenna. This is typically inside the cavity. Outside the cavity and after passing the radiating region or possibly the gap, respectively, the electromagnetic waves propagate based on the local conditions and the antenna characteristic.

The radiating region preferably has an area in this case which at least corresponds to the size of the patch antennas, or which is smaller than the size of the patch antennas. The same can be said for the clearance of the gap.

The patch antenna is preferably circularly polarized such that the electromagnetic waves or the electromagnetic field, respectively, are circularly polarized, and therefore the electromagnetic waves are emitted circularly. The circularly polarized field has the advantage that the electromagnetic waves can also penetrate a radiating region or a gap, respectively, which corresponds to half the wavelength or which is smaller than half the wavelength.

Said patch antennas of the transmitter and those of the receiver are preferably located substantially in a common plane.

The cavity is preferably designed so it cannot be penetrated by said electromagnetic waves except in the radiating region. This means said electromagnetic waves can exclusively exit via said radiating region.

According to a first variant, the cavity is provided, except in the radiating region, with a coating which cannot be penetrated by said electromagnetic waves, wherein the coating is preferably an electrically conductive, in particular a metallic coating. It can be ensured by the coating that the electromagnetic waves can leave the cavity exclusively via the radiating region.

According to a second variant, the wall of the cavity is formed, except in the radiating region, by a material which cannot be penetrated by said electromagnetic waves.

The radiating region and the gap are preferably arranged substantially congruent to one another when viewed in the main direction of said electromagnetic waves. This means that the shape and the extension of the gap and the radiating region are substantially equivalent to one another. In addition, gap and radiating region are located substantially one on top of another when viewed in the main direction. However, it is also conceivable that either the gap or the radiating region is larger than the radiating region or the gap.

This means the main direction extends substantially parallel to the installation plane in the region of the radiating region and the gap, wherein the electromagnetic waves can exit from the gap substantially in the main direction and then propagate further in the space accordingly.

The radiating region and/or the gap are preferably substantially rectangular and each have a length which corresponds to a multiple of the wavelength of the electromagnetic waves emitted by the detection sensor.

The radiating region and/or the gap preferably has a width in a first embodiment which corresponds to the wavelength of the electromagnetic waves emitted by the detection sensor.

In a second embodiment, the radiating region and/or the gap has a width which corresponds to half of the wavelength of the electromagnetic waves emitted by the detection sensor. The space requirement in the actuating device can be optimized accordingly in this way. This embodiment is particularly advantageous if the above-mentioned patch antenna is used, in particular with the circular polarization.

In a third embodiment, the radiating region and/or the gap has a width which corresponds to a dimension less than half the wavelength of the electromagnetic waves emitted by the detection sensor. In this way, the space requirement in the actuating device can be further optimized. This embodiment is particularly advantageous if the above-mentioned patch antenna is used, in particular with the circular polarization.

The housing preferably has a front element having the front side and a rear element having the rear side, which are connectable to one another. In particular, the front element and the rear element are connectable to one another via a latching connection or another mechanical connection. Different variants are conceivable with respect to the arrangement of the cavity:

- said cavity is arranged having the radiating region on the front element;
- said cavity is arranged having the radiating region on the rear element;
- said cavity is arranged having the radiating region on the front element and on the rear element.

The front element preferably has actuating buttons for activating flushing. In this embodiment, the flushing can be activated manually, while another function, for example, switching on a night light or activating a shower-toilet, can be actuated using the detection sensor.

In an alternative embodiment, the actuating device is part of an outlet fitting, which furthermore comprises an outlet pipe.

The radiating region is preferably made of plastic, in particular of a thermoplastic, preferably having a relative permittivity or a dielectric conductivity of $\varepsilon_r$ between 3 and 5, respectively. This permittivity is particularly advantageous if the radiating region or the gap, respectively, has a width which corresponds to half the wavelength or which is less than half the wavelength, and if the above-mentioned patch antenna, in particular the circularly polarized patch antenna is used.

The housing is particularly preferably a rectangle or a square when viewed in the direction of the surface normal on the front side, wherein a lateral face extends from the front side in the direction of the surface normal from the edge of the rectangle or the square, wherein the radiating region or the gap, respectively, is arranged in the region of the lateral face. This means the main direction of the electromagnetic waves extends substantially perpendicular to the surface normal. In particular with this arrangement, the above-described width is advantageous because then the extension of the lateral face can be selected as smaller.

The extension of the lateral face in the direction of the surface normal is preferably multiple times less than the extension of the front side transverse to the surface normal.

The actuating device preferably furthermore has at least one light source, the light of which can be emitted via said radiating region or the gap, respectively, or via a passage arranged separately from the radiating region.

The light source can be controlled by the signal provided by the detection sensor.

The light source is particularly preferably arranged on the same circuit board as the detection sensor.

One arrangement comprises an actuating device according to the above description and also a sanitary article, wherein both the actuating device and also the sanitary article are fastened on said installation plane, and wherein the radiating region or the possibly provided gap, respectively, is oriented toward the sanitary article. The sanitary article is preferably a wash basin, a toilet bowl, or a urinal.

Further embodiments are specified in the dependent claims.

BRIEF DESCRIPTION OF THE DRAWINGS

Preferred embodiments of the invention will be described hereafter on the basis of the drawings, which are merely used for explanation and are not to be interpreted as restrictive. In the figures.

DESCRIPTION OF PREFERRED EMBODIMENTS

An actuating device 1 for a sanitary fitting is shown in the figures. The actuating device 1 is used for the purpose of activating a function in conjunction with a sanitary fitting. The function can be, for example, the activation of a flushing and/or the control of a lower spray nozzle and/or the control of a light and/or the actuation of a water valve in an outlet fitting and/or another sanitary function. The sanitary fitting is preferably a toilet or a urinal or a washbasin or another element.

Figure 4:
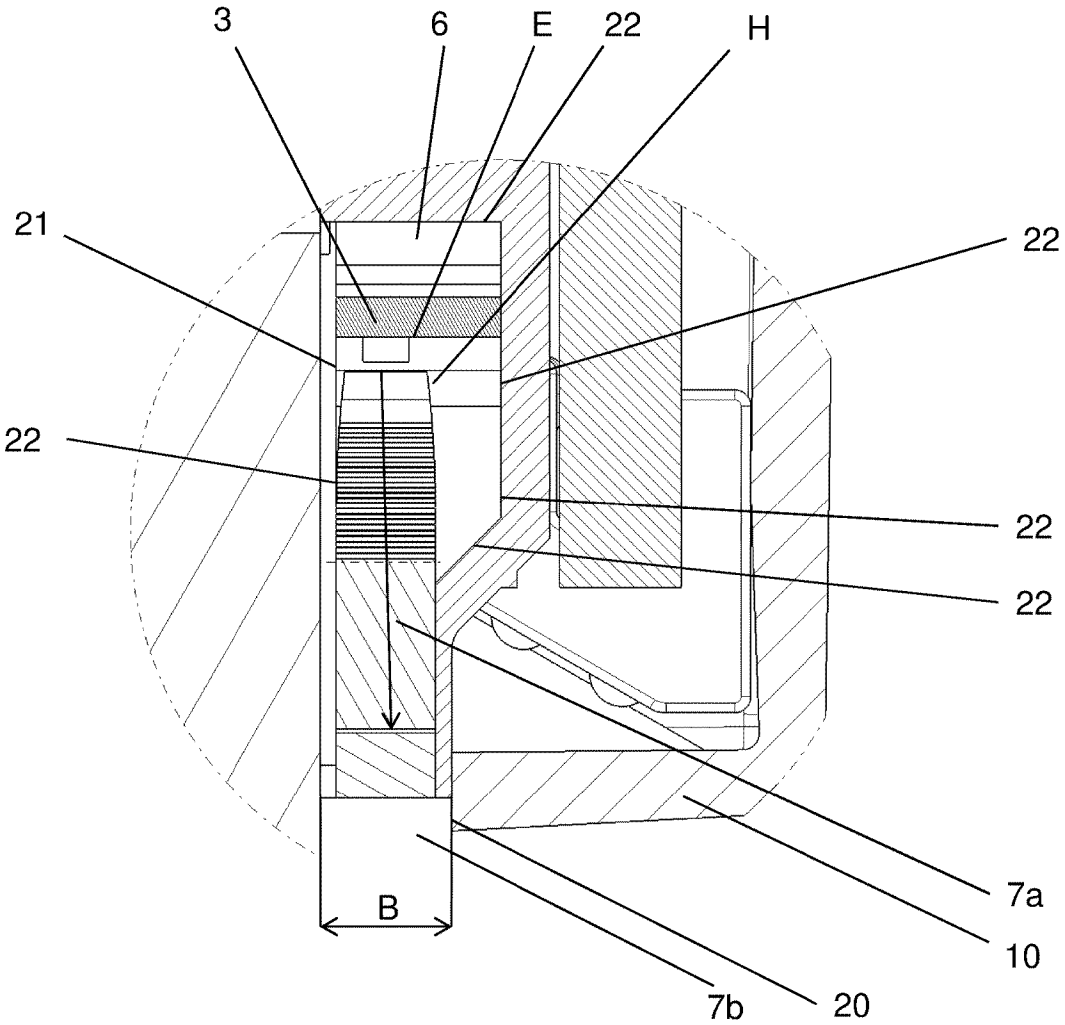
FIG. 4 shows a detail view of the detail Z according to FIG. 3.
Figure 5:
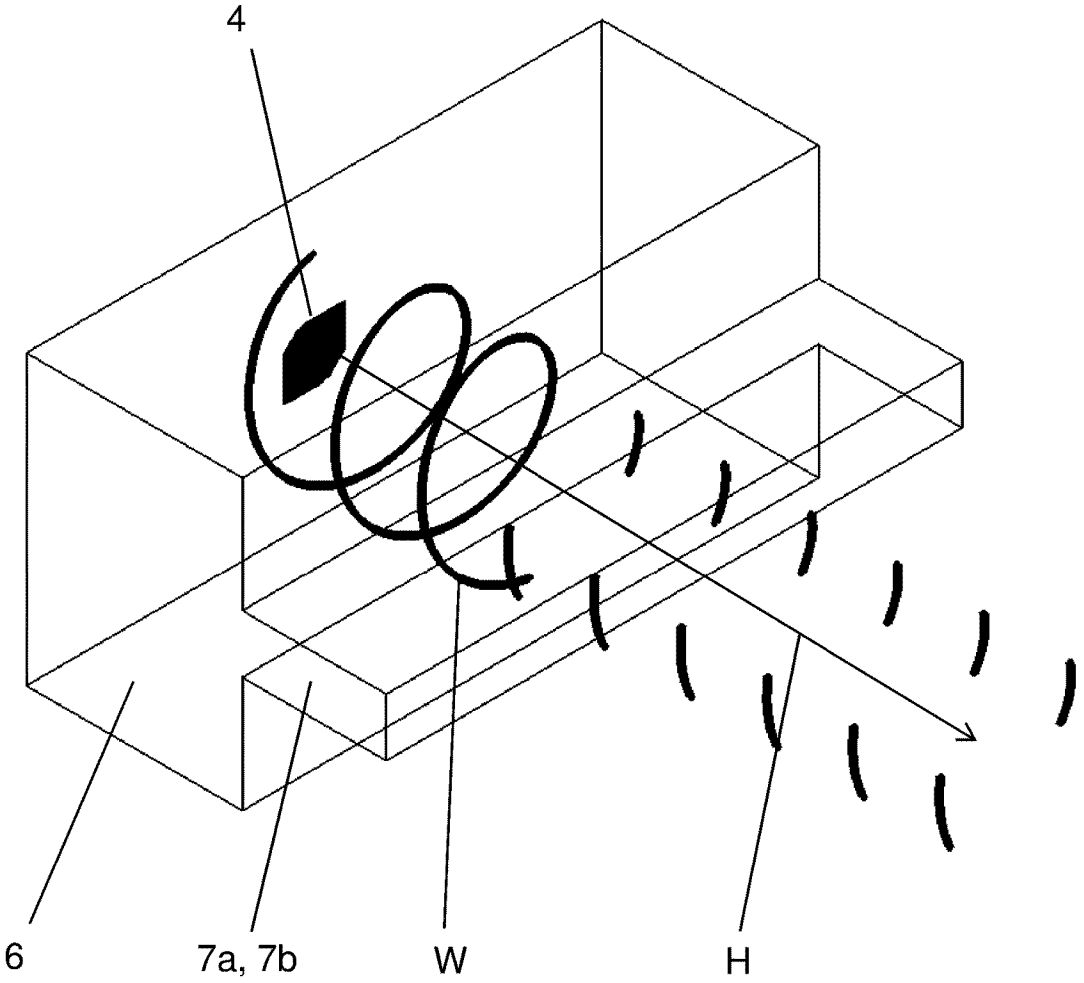
FIG. 5 shows a schematic view of the propagation of the electromagnetic waves of a detection sensor of the actuating device according to FIG. 1.
Figure 6:
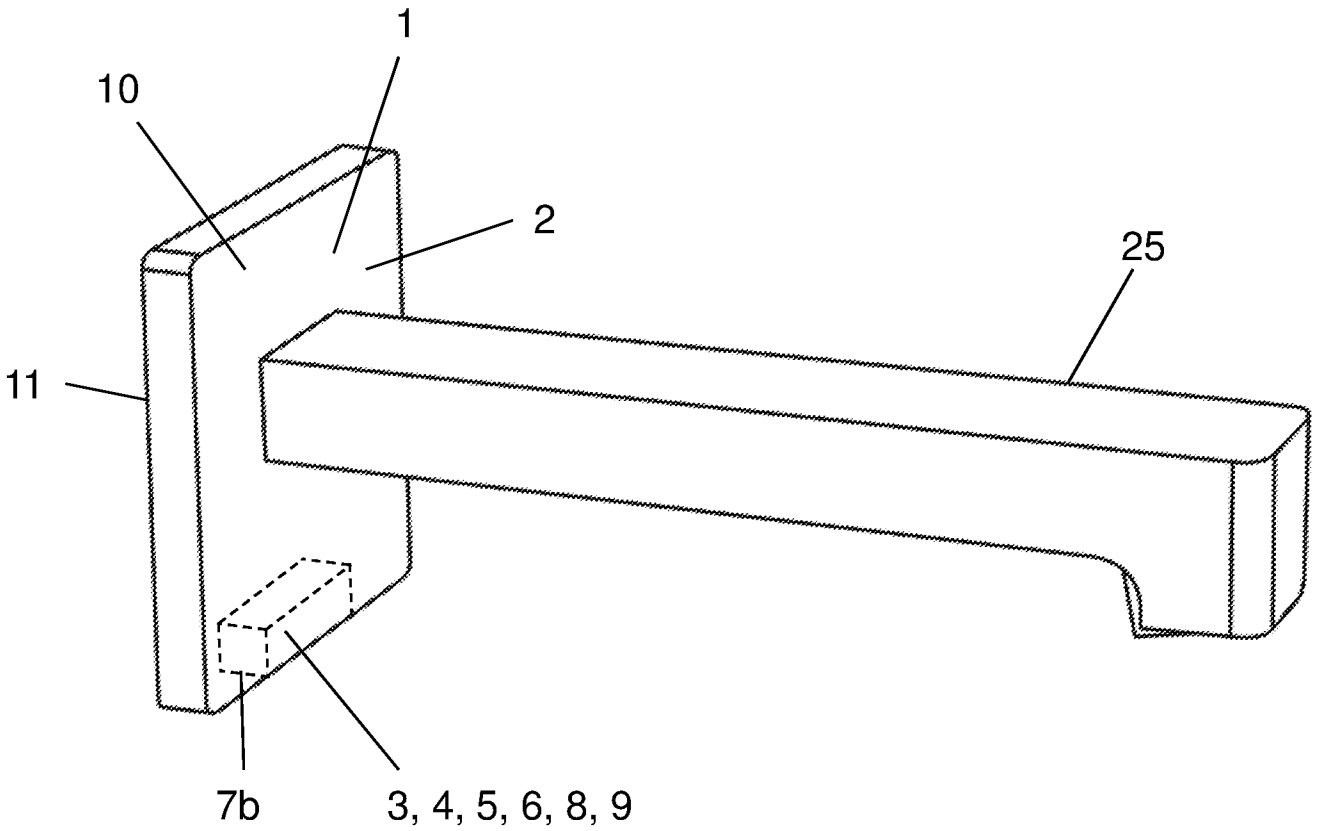
FIG. 6 shows a perspective view of an actuating device according to a further embodiment.

In FIGS. 1 to 5, the actuating device is shown as an actuating plate and in FIG. 6 it is shown as an outlet fitting. Identical parts are provided with identical reference signs in this case.

The actuating device 1 comprises a housing 2 having a front side 13 and a rear side 14. The front side 13 is recognizable by the user in the installed state. The actuating device is connected via the rear side 14 to a wall or an installation framework or a part of the sanitary fitting in the installed state. Furthermore, the actuating device 1 comprises a detection sensor 3 having a transmitter 4 and a receiver 5. The detection sensor 3 is used to detect a user, who uses the sanitary fitting. The detection sensor 3 emits waves via the transmitter 4, which are then reflected on a user and are received again by the receiver 5. The detection sensor 3 can then recognize a user based on the emitted or received waves, respectively, and emit a corresponding signal. The signal is then used as a control signal for activating said function.

The detection sensor 3 is mounted in a cavity 6 of the housing 2. A cavity 6 is understood in the present case as a receptacle space, which is arranged in or on the housing 2 or is provided by the housing 2, respectively. The cavity 6 has a radiating region 7*a* in the direction of said waves. The radiating region 7*a* is transparent to said waves. This means said waves can exit from the cavity 6 through the radiating region 7*a*. The radiating region 7*a* can be formed in this case as a passage or it can be formed from a material which is transparent to the waves emitted by the detection sensor 3. This means the waves can penetrate outward through the material.

In the embodiment shown, the cavity 6 is closed by a cover 21.

Figure 2:
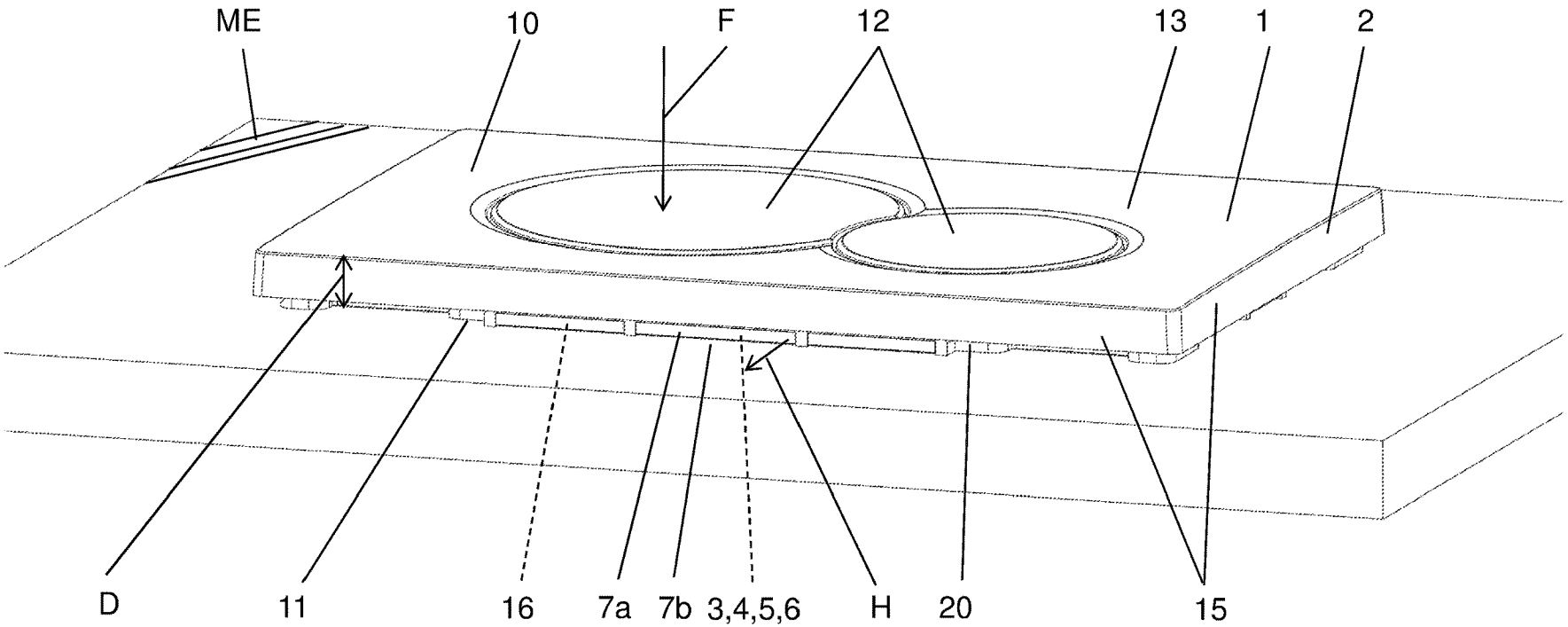
FIG. 2 shows a perspective view of the actuating device according to FIG. 1.

The housing 2 is designed in the preferred embodiment shown, as shown in FIGS. 2 and 4, such that it is installable having a gap 7*b* in relation to an installation plane ME predefined by the structure. The installation plane ME is, for example, a wall covered with tiles or the front side of an installation frame or the surface of the sanitary fitting. The installation plane ME represents the final state in this case, i.e., no elements are arranged which are placed on the installation plane ME. The gap 7*b* is located in relation to said radiating region 7*a* in this case such that the emitted waves and also the waves to be received coming from the radiating region 7*a* are guided through the gap 7*b*.

It is apparent from FIG. 4 that the waves are emitted by the detection sensor 3 along a main direction H and firstly pass the radiating region 7*a* and then pass the gap 7*b*. The arrangement of radiating region 7*a* and of gap 7*b* has the advantage that the actuating device 1 can be used independently of the materialization of the installation plane ME predefined by the structure. It has been shown in the field of use that the materialization of the installation plane ME can vary greatly and under certain circumstances negatively influences the waves of the detection sensor or makes a passage impossible, respectively. As a result of the arrangement of the radiating region 7*a* and the gap 7*b*, an actuating device 1 is thus provided which can be used in all intended purposes.

The detection sensor 3 is preferably a high-frequency sensor, the frequency of which is preferably at 24 GHz.

Figure 1:
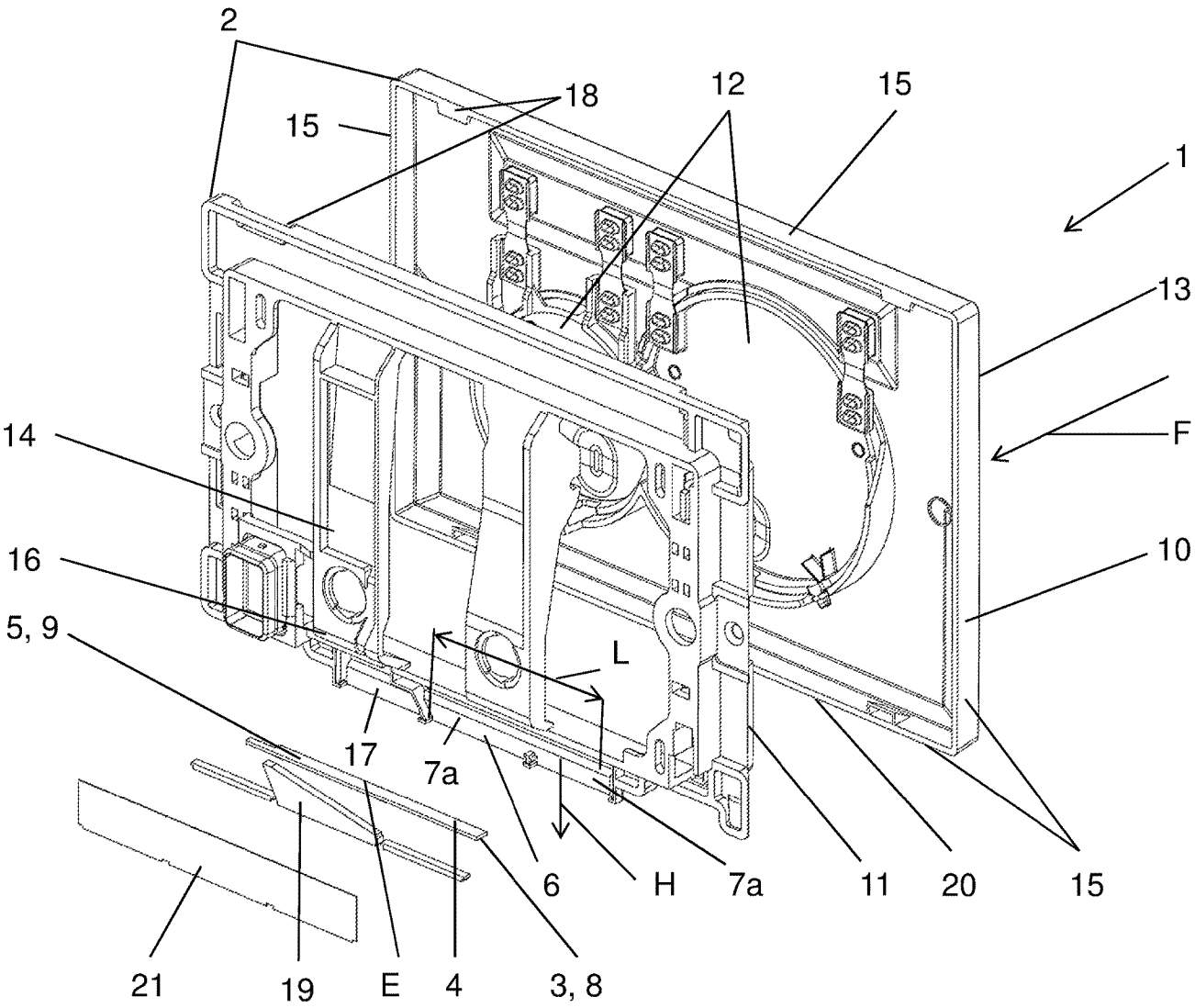
FIG. 1 shows a perspective exploded illustration of an actuating device according to one embodiment of the present invention.

The transmitter 4 has a transmitter antenna 8 and the receiver 5 has a receiver antenna 9. The waves are emitted via the antennas. Both the transmitter antenna 8 and also the receiver antenna 9 are designed substantially in the form of a patch antenna. A patch antenna is understood in this context as an antenna which is preferably located in one plane. In the embodiment shown, the transmitter antenna 8 and the receiver antenna 9 are located on a common circuit board, which is shown in FIG. 1. The main direction H, in which the waves of the transmitter 4 are emitted, extends from this circuit board substantially orthogonally to the plane in which the patch antennas are located.

The radiating region 7*a* has an area which corresponds to at least the size of the transmitter antenna 8 and the receiver antenna 9 or the patch antenna, respectively. Similarly, the gap 7*b* has a clearance which corresponds to at least the size of the transmitter antenna 8 and the receiver antenna 9 or the patch antennas, respectively. It is thus ensured that all waves which are emitted by the transmitter 4 and received by the receiver 5 can exit unobstructed from the cavity and the housing 2 and can enter again unobstructed.

Moreover, reference is made to FIG. 5 in conjunction with the wave propagation of the transmitter 4, on the basis of which the wave propagation will be explained in greater detail. FIG. 5 schematically shows a part of the patch antenna, and also the radiating region 7*a* or the gap 7*b*, respectively. The waves W generally propagate in the direction of the main direction H. This means that the electrical field extends in the direction of the main direction H. The patch antenna polarizes the electrical field such that a circular polarization of the field is achieved. The circularly polarized field rotates with time about the axis of the main direction H. A type of spiral results, which rotates about the main axis H.

The antenna is typically selected such that the electrical field or the waves, respectively, extend in the direction parallel to the feed. The antennas are preferably fed from the left and right according to the preferred embodiment. During half of the time, the electrical field is oriented such that it is parallel or approximately parallel to the gap, while the other half of the time, however, the electrical field is perpendicular or approximately perpendicular to the gap. In this case, the waves can pass through the gap and radiate forward. Thereby, the waves W will leave the gap.

The cavity 6, except in the radiating region 7*a*, preferably has a coating which cannot be penetrated by said waves. In this case, essentially the entire interior of the cavity 6, except for the radiating region 7*a*, is provided with the coating. If the cover 21 is provided, the cover 21 is also provided on the side facing toward the cavity 6 with a metallic coating. The coated inner sides bear the reference sign 22. The cover can also be a metallic cover, however. The coating is typically a metallic coating. The advantage is provided by the coating that the waves exclusively exit from the cavity 6 via said radiating region 7*a* and focusing can thus be achieved. Moreover, incorrect detections can be practically precluded.

As shown by the detail view of FIG. 4, the radiating region 7*a* and the gap 7*b* are substantially congruent when viewed in the main direction H of said waves. This means the radiating region 7*a* and the gap 7*b* are located one on top of another in the main direction H such that a "clearance" through the radiating region 7*a* and the gap 7*b* is provided for the waves, through which "clearance" said waves can exit or enter, respectively. In this context, "clearance" means a clearance which is transparent for the waves. This does not necessarily have to be a "clearance" in which no material is located in the radiating region. However, the material has to be transmissive or transparent, respectively, to the waves as described above in conjunction with the radiating region.

The radiating region 7*a* and the gap 7*b* essentially have a rectangular basic shape. The rectangular basic shape therein has a length in this case which corresponds to a multiple of the wavelength of the waves emitted by the detection sensor 3. The length L is shown in FIG. 1.

The radiating region 7*a* and the gap 7*b* both have a width B which corresponds at most to the wavelength of the waves emitted by the detection sensor 3. It has proven to be particularly advantageous if the radiating region 7*a* and the gap 7*b* have a width which corresponds to half of the wavelength of the waves emitted by the detection sensor 3. Due to this design, the gap 7*b* and also the radiating region 7*a* can be selected to be as small as possible, which is advantageous for the total thickness of the actuating device 1, since it can be minimized accordingly. The width B is shown in FIG. 4. The width B is typically approximately 4 mm, which is dependent on the wavelength, however, as mentioned. The above-described propagation of the waves enables the provision of a comparatively thinner gap 7*b* or a comparatively thinner radiating region 7*a*, respectively.

Figure 3:
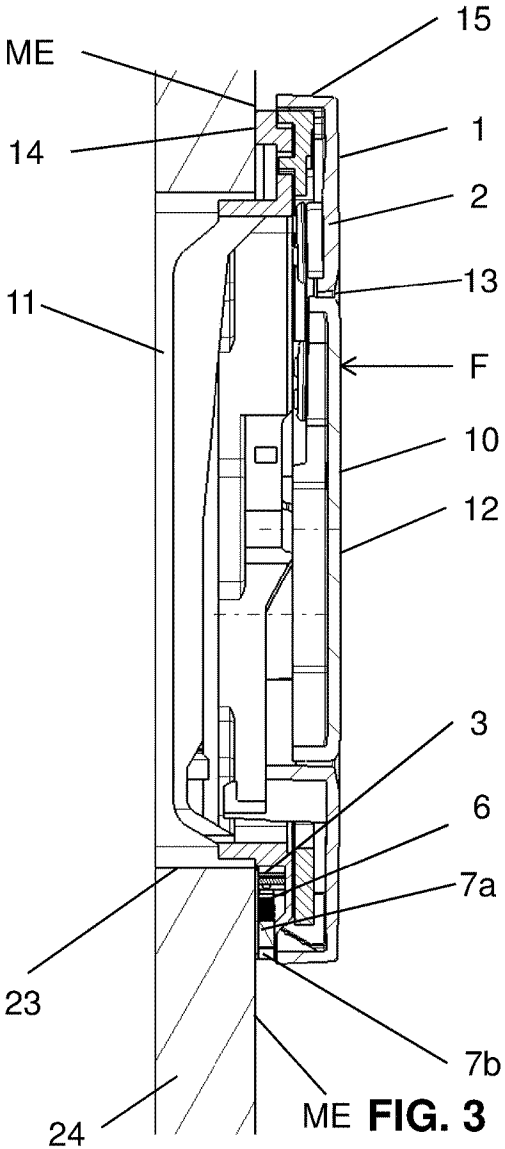
FIG. 3 shows a sectional illustration along section line III-III of FIG. 2.

With respect to the shape of the housing 2, it can be seen well from FIG. 1 that, viewed in the direction of the surface normal F on the front side 13, the housing 2 has the form of a rectangle. However, the housing 2 can also have the form of a square or another shape. A lateral face 15, which is substantially provided here by the front element 10, extends from the front side 13 in the direction of the surface normal F. In this case, the radiating region 7*a* or the gap 7*b*, respectively, are arranged in the region of the lateral face 15. This means the main direction H of the waves from the detection sensor 3 is perpendicular to the surface normal F and substantially parallel to the installation plane ME. The housing is typically arranged in the installation position such that the main direction H is oriented downward in the direction of gravity, and therefore a user sitting down on a toilet or stepping up to a urinal can be recognized. It is to be noted in this context that the waves move not only in the main direction H but rather also away from the installation plane ME, as indicated in FIG. 3, after exiting from the gap 7*b*.

The extension B of the lateral face 15 is multiple times smaller in the direction of the surface normal F than the extension of the front side 13 transversely to the surface normal F.

As can be seen well from the figures, the housing 2 has a front element 10 having the front side 13 and a rear element 11 having the rear side 14. The two elements 10, 11 are connectable to one another via a latching connection 18. In the embodiment shown, said cavity 6 having the radiating region 7*a* is located on the rear element 11. An arrangement on the front element 10 or even a joint provision of the cavity 6 between the front element 10 and the rear element 11 would also be conceivable. The gap 7*b* is provided by the spaced-apart arrangement of the front element 10 in relation to the installation plane ME.

Furthermore, the front element 10 has at least one, here two, actuating buttons 12 for activating a flushing. In the embodiment shown, actuating device 1 moreover has a light source 16, the light of which is emittable via said radiating region 7*a* or the gap 7*b*, respectively. This means the light source 16 is actuated via the signal of the detection sensor 3, while the flushing is manually activated via the actuating buttons 12 in the embodiment shown. The actuating device 1 shown in the present case is thus essentially used as an actuating device 1, using which, for example, a nightlight can be provided. In other embodiments, it is conceivable to omit the actuating buttons 12 and to use the signal of the detection sensor for the activation of the flushing. In still another embodiment, it would be conceivable to also arrange the actuating buttons and to use the signal of the detection sensor for the starting or the activation of a lower spray nozzle.

The light source 16 is preferably arranged on the same circuit board as the detection sensor 3. In the embodiment shown, the light source 16 is arranged to the left of the detection sensor 3 or the patch antennas of the detection sensor 3, respectively. In this case, the light of the light source 16 is coupled into an optical waveguide and decoupled again in the region of the gap 7*b*. The optical waveguide bears the reference sign 19.

It can be recognized well from FIG. 4 with respect to the gap 7 that this gap is provided in that the front element 10 stops at the rear element 11 and does not overlap it. The corresponding gap 7*a* is provided between a rear edge 20 of the front element 10 and the installation plane ME.

Furthermore, it can be recognized well from FIG. 4 that parts of the rear element 11 extend through an opening 23 of the installation plane ME. It is also shown in this sectional illustration that the installation plane ME is the front side of a wall structure 24.

In FIG. 6, as mentioned, the actuating device 1 is shown in conjunction with an outlet fitting. Identical parts are provided with identical reference signs. A water tap 25 which is arranged instead of the actuating buttons according to the embodiment in the other figures extends from the front side 13 here. The installation of the corresponding sensor parts is symbolized by the dashed lines.

LIST OF REFERENCE SIGNS

1 actuating device
2 housing

3 detection sensor
4 transmitter
5 receiver
6 cavity
7*a* radiating region
7*b* gap
8 transmitter antenna
9 receiver antenna
10 front element
11 rear element
12 actuating buttons
13 front side
14 rear side
15 lateral face
16 light source
17 passage
18 latching connection
19 optical waveguide
20 rear edge
21 cover
22 coated inner side
23 opening
24 wall structure
25 water tap
H main direction
D extension
ME installation plane
E plane
F surface normal
B width
L length
W waves

The invention claimed is:

1. An actuating device for a sanitary fitting for the purpose of activating a function, wherein the actuating device comprises a housing having a front side and a rear side and also a detection sensor having a transmitter and a receiver for detecting a user, wherein the detection sensor emits waves via the transmitter and receives them via the receiver, wherein the detection sensor is arranged in a cavity of the housing, wherein the cavity has a radiating region, which is transparent to said waves, in the direction of said electromagnetic waves, and wherein the housing has a lateral face, which extends in the direction of the surface normal of the front side at least partially between front side and rear side, wherein the radiating region is arranged in the region of the lateral face or in the lateral face, respectively.

2. The actuating device according to claim 1, wherein the housing is formed in such a way that it is installable with a gap in relation to a predefined installation plane on the structure side, which gap is located in relation to said radiating region in such a way that the emitted waves and also the waves to be received are guided by the gap.

3. The actuating device according to claim 2, wherein the detection sensor is a high-frequency sensor, the frequency of which is preferably in the range of 24 GHz to 24.25 GHz or is 61 GHz or 76 GHz.

4. The actuating device according to claim 1, wherein the detection sensor is a high-frequency sensor, the frequency of which is preferably in the range of 24 GHz to 24.25 GHz or is 61 GHz or 76 GHz.

5. The actuating device according to claim 1, wherein the transmitter has a transmitter antenna in the form of a patch antenna, and/or wherein the receiver has a receiver antenna in the form of a patch antenna.

6. The actuating device according to claim 5, wherein the radiating region has an area which at least corresponds to the size of the patch antennas, or which is smaller than the size of the patch antennas; and/or wherein the gap has a clearance which at least corresponds to the size of the patch antennas or which is smaller than the size of the patch antennas; and/or wherein said patch antennas are essentially located in a common plane; and/or wherein the patch antenna is circularly polarized.

7. The actuating device according to claim 1, wherein the cavity is formed so it cannot be penetrated by said electromagnetic waves except in the radiating region, wherein the cavity is provided, except in the radiating region, with a coating which cannot be penetrated by said waves, wherein the coating is preferably formed as being electrically conductive; or wherein the wall of the cavity is formed, except in the radiating region, by a material which cannot be penetrated by said waves.

8. The actuating device according to claim 1, wherein the radiating region and the gap are substantially congruent when viewed in the main direction of said waves.

9. The actuating device according to claim 1, wherein the radiating region and/or the gap is substantially rectangular and preferably has a length which corresponds to a multiple of the wavelength of the electromagnetic waves emitted by the detection sensor.

10. The actuating device according to claim 1, wherein the radiating region and/or the gap has a width which corresponds to the wavelength of the electromagnetic waves emitted by the detection sensor; or wherein the radiating region has a width which corresponds to half of the wavelength of the electromagnetic waves emitted by the detection sensor; or wherein the radiating region and/or the gap has a width which corresponds to a dimension smaller than half of the wavelength of the electromagnetic waves emitted by the detection sensor.

11. The actuating device according to claim 1, wherein the housing has a front element having the front side and a rear element having the rear side, which are connectable to one another, wherein said cavity having the radiating region is arranged on the front element;

or wherein said cavity is arranged on the rear element having the radiating region;

or wherein said cavity is arranged having the radiating region on the front element and on the rear element.

12. The actuating device according to claim 11, wherein the front element has actuating buttons for activating a flushing.

13. The actuating device according to claim 1, wherein the actuating device is part of an outlet fitting, which furthermore comprises an outlet pipe.

14. The actuating device according to claim 1, wherein the radiating region consists of plastic, in particular a thermoplastic, preferably having a relative permittivity $\varepsilon_r$ of between 3 and 5, and/or wherein the extension of the lateral face in the direction of the surface normal is multiple times smaller than the extension of the front side transversely to the surface normal.

15. The actuating device according to claim 1, wherein the actuating device furthermore has at least one light source, the light of which is emittable via said radiating region or the gap, respectively, or via a passage arranged separately from the radiating region.

16. An arrangement comprising an actuating device according to claim 1 and also a sanitary article, wherein both the actuating device and also the sanitary article are fastened on said installation plane, and wherein the radiating region and/or the gap is oriented toward the sanitary article.

* * * * *